US005826657A

United States Patent [19]

Ringgenberg

[11] Patent Number: 5,826,657

[45] Date of Patent: Oct. 27, 1998

[54] SELECTIVELY LOCKING OPEN A DOWNHOLE TESTER VALVE

[75] Inventor: Paul D. Ringgenberg, Carrollton, Tex.

[73] Assignee: Halliburton Energy Services, Inc., Dallas, Tex.

[21] Appl. No.: 788,071

[22] Filed: Jan. 23, 1997

[51] Int. Cl.[6] ..... E21B 34/10

[52] U.S. Cl. ..... 166/336; 166/323; 166/324; 166/373

[58] Field of Search ..... 166/319, 321, 166/323, 324, 336, 373

[56] References Cited

U.S. PATENT DOCUMENTS 4,633,952 1/1987 Ringgenberg ..... 166/264 X
4,665,983 5/1987 Ringgenberg ..... 166/264
4,711,305 12/1987 Ringgenberg ..... 166/264 X
5,484,022 1/1996 Coutts et al. ..... 166/324 X

*Primary Examiner*—Roger J. Schoeppel
*Attorney, Agent, or Firm*—William M. Imwalle; Lawrence R. Youst

[57] ABSTRACT

A downhole tool apparatus (34) including a housing (42) adapted to be connected in a pipe string (30), the housing (42) having a generally cylindrical bore (44) defined therein, an operating assembly (112) disposed within the cylindrical bore (44) of the housing (42) having open and closed positions and a mandrel (142) slidably received in the cylindrical bore (44) of the housing (42) and adapted to be selectively telescoped between first and second axial positions relative to the housing (42) to manipulate the operating assembly (112) and selectively rotated between first and second circumferential positions relative to the housing (42) to selectively lock the mandrel (142) in an axial position relative to the housing (42).

23 Claims, 5 Drawing Sheets

SELECTIVELY LOCKING OPEN A DOWNHOLE TESTER VALVE

TECHNICAL FIELD OF THE INVENTION

This invention relates, in general, to a downhole tool apparatus for use in oil or gas wells and, in particular to, a downhole tester valve tool which may be selectively open and closed and which may be selectively locked in an open position.

BACKGROUND OF THE INVENTION

Without limiting the scope of the present invention, its background is described with reference to downhole tester valves, as an example.

During the course of drilling an oil or gas well, one operation which is often performed is to lower a testing string into the well to test the production capabilities of a hydrocarbon producing underground formation intersected by the well. Testing is typically accomplished by lowering a string of pipe, generally drill pipe or tubing, into the well with a packer attached to the test string at its lower end. Once the test string is lowered to the desired final position, the packer is set to seal off the annulus between the test string and the wellbore or casing, and the formation tester valve is opened to allow the underground formation to produce oil or gas into the test string.

The operation of these downhole tester valve tools typically involves the use of a tool having telescoping action between two portions of the tool which serves to open the tester valve when weight is set down on the tool after the packer has been set in the well below the tool. This telescoping action occurs relatively slowly due to the hydraulic time delay built into the tool. The purpose of this time delay is to allow the formation tester valve to transmit compressional hydraulic forces for relatively short periods of time without actuating the valve, and to transmit weight through its hydraulic impedent system to apply drill pipe weight to the packer below.

The hydraulic time delay built into the tool, serves several purposes. For example, when the well test string is being run into the wellbore, the test string often encounters obstructions in the wellbore and weight must be set down on the test string for a short period of time in order to push the test string past these obstructions. Similarly, once the test string is in its desired location, various tools located below the downhole tester valve tool, such as the packer, often are designed to be set by lowering drill pipe weight on the test string. The packer must seal against the wellbore or the casing before the tester valve opens, and this is assured by the time delay built into the telescoping action of the downhole tester valve tool.

Thus, it has been found desirable to provide such formation tester valves with a hydraulic time delay device which requires that sufficient weight be set down on the downhole tester valve tool for a sufficient period of time, on the order of several minutes, before the downhole tester valve tool actually opens. Additionally, hydraulic time delay devices have been constructed so that the final portion of the telescoping motion will occur very rapidly, thus jiggling the drill pipe at the surface and providing a positive indication to personnel operating the well that the downhole tester valve tool is open. Once the downhole tester valve is open, the flow test of the hydrocarbon producing zone of the well may commence.

After the flow test is completed and it is desirable to return the downhole tester valve tool to the closed position, the weight of the drill pipe is removed from the test string which reverses the telescoping motion of the downhole tester valve tool placing the tool in the closed position. In closing the downhole tester valve tool, the hydraulic time delay device is typically bypassed in order to quickly reset the tool to require a full hydraulic time delay when drill pipe weight is again lowered on the test string. Similarly, to assure that the downhole tester valve tool is in a fully closed position after the test string encounters an obstruction in the wellbore, once the drill pipe weight is no longer on the test string, any hydraulic fluid which has passed through the hydraulic time delay device will quickly bypass the hydraulic time delay device, returning the downhole tester valve to the fully closed position.

It has been found, however, that it may be desirable to pick up on the tool, thereby removing the drill pipe weight from the drill string, without returning the downhole tester valve to a closed position but rather leaving the downhole tester valve tool in a fully opened position. For example, it may be desirable to unset the packer in order to circulate fluid down around the packer and up through the work string to clean the system.

Therefore, a need has arisen for an apparatus and a method for locking a downhole tester valve tool in an open position so that the weight of the drill pipe may be removed from the downhole tester valve tool without returning the downhole tester valve tool to a closed position. A need has also arisen for a downhole tester valve tool which is simple to lock in a fully open position and simple to return to normal operation.

SUMMARY OF THE INVENTION

The present invention disclosed herein comprises a downhole tester valve tool which may be selectively locked in a fully open position so that the weight of the drill pipe may be removed from the downhole tester valve tool without returning the downhole tester valve tool to a closed position. The downhole tester valve tool apparatus of the present invention comprising a housing, an operating assembly disposed within the housing and a mandrel axially movable within the housing to engage and operate the operating assembly. The mandrel is also rotatably movable within the housing to selectively lock the mandrel in an axial position relative to the housing.

The downhole tool of the present invention further comprises a sleeve assembly that is rotatably disposed within the housing for receiving the mandrel. The housing and the sleeve assembly each define a plurality of sheer member openings through which a plurality of sheer members radially extend to prevent relative rotation between the housing and the sleeve assembly until a predetermined amount of torsional force is applied on the sleeve assembly by the mandrel.

Both the housing and the sleeve assembly define channels which receive a spline which extends radially outward from the mandrel. In one embodiment, the housing has an upper shoulder and the spline of the mandrel has a lower shoulder such that when the mandrel is rotated relative to the housing, the upper shoulder of the housing is in close contact with the lower shoulder of the mandrel, thereby locking the mandrel in an axial position relative to the housing.

In another embodiment, the housing has first and second upper shoulders and the spline of the mandrel has first and second lower shoulders such that when the mandrel is rotated relative to the housing, the first upper shoulder of the housing is in close contact with the first lower shoulder of the mandrel and the second upper shoulder of the housing is in close contact with the second lower shoulder of the mandrel, thereby locking the mandrel in an axial position relative to the housing.

BRIEF DESCRIPTION OF THE DRAWINGS

For a more complete understanding of the present invention, including its features and advantages, reference is now made to the detailed description of the invention, taken in conjunction with the accompanying drawings in which like numerals identify like parts and in which:

FIG. 2, including

FIG. 3, including

DETAILED DESCRIPTION OF THE INVENTION

While the making and using of various embodiments of the present invention are discussed in detail below, it should be appreciated that the present invention provides many applicable inventive concepts which may be embodied in a wide variety of specific contexts. The specific embodiments discussed herein are merely illustrative of specific ways to make and use the invention, and do not delimit the scope of the invention.

Figure 1:
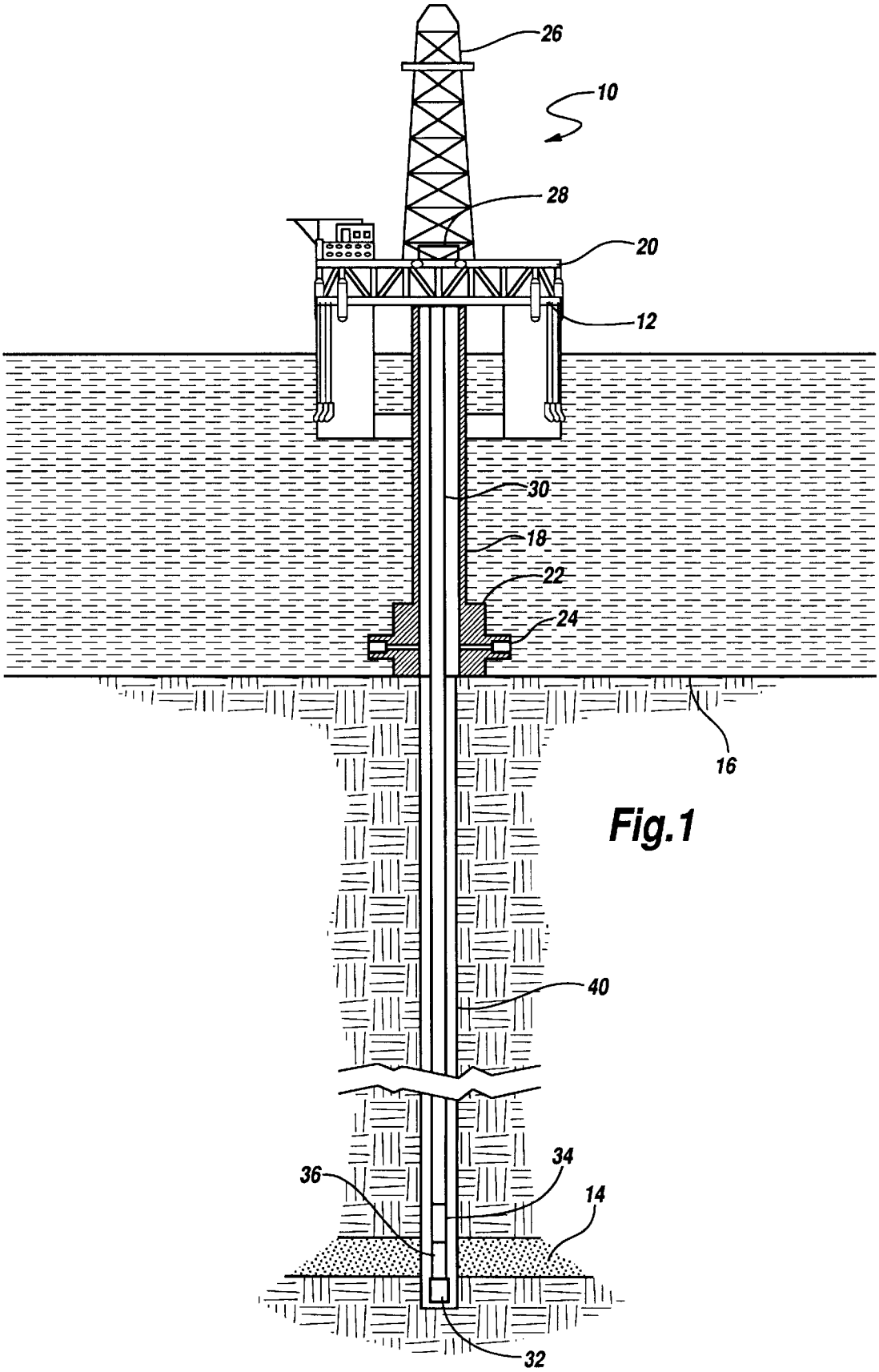
FIG. 1 is a schematic illustration of an offshore oil or gas drilling platform operating a downhole tester valve tool of the present invention.

Referring to FIG. 1, a downhole tester valve tool in use on an offshore oil or gas drilling platform is schematically illustrated and generally designated 10. A semi-submersible drilling platform 12 is centered over a submerged oil or gas formation 14 located below sea floor 16. A subsea conduit 18 extends from deck 20 of platform 12 to a wellhead installation 22, including blow-out preventor 24. The platform 12 has a derrick 26 and a hoisting apparatus 28 for raising and lowering drill string 30 with end cap 32 and tools to test the oil or gas formation 14, including downhole tester valve tool 34 and seal assembly 36.

During a testing operations, drill string 30 is lowered into wellbore 40 after formation 14 has been intersected by wellbore 40 in a drilling operation. Tool 34 and seal assembly 36 may be located above end cap 32. Seal assembly 36 may be set to seal the interior of drill string 30 from wellbore 40. Once seal assembly 36 has sealed off the area between wellbore 40 and drill string 30, formation fluids may be produced into drill string 30 through tool 34.

It should be understood by one skilled in the art that tool 34 of the present invention is not limited to use with semi-submersible drilling platform 12 as shown in FIG. 1. Tool 34 is equally well-suited for use with conventional offshore drilling rigs or during onshore drilling operations. It should also be understood by one skilled in the art that, even though FIG. 1 depicts an uncased vertical well, tool 34 of the present invention is equally well-suited for cased vertical wells, and for cased or uncased deviated or horizontal wells.

Figure 2A:
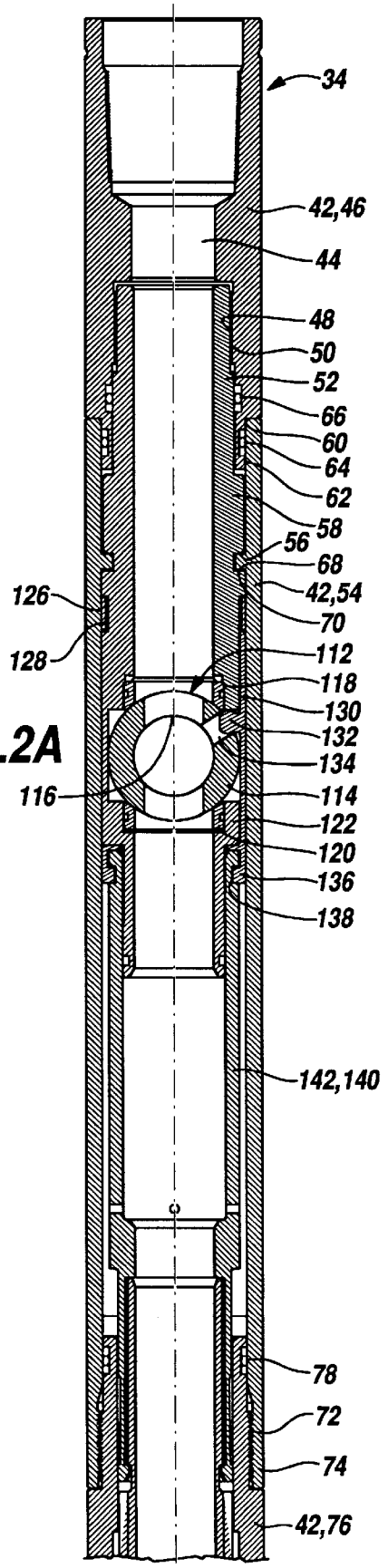
FIGS. 2A–2C, is a half-sectional view of a downhole tester valve tool of the present invention in an open position.
Figure 3A:
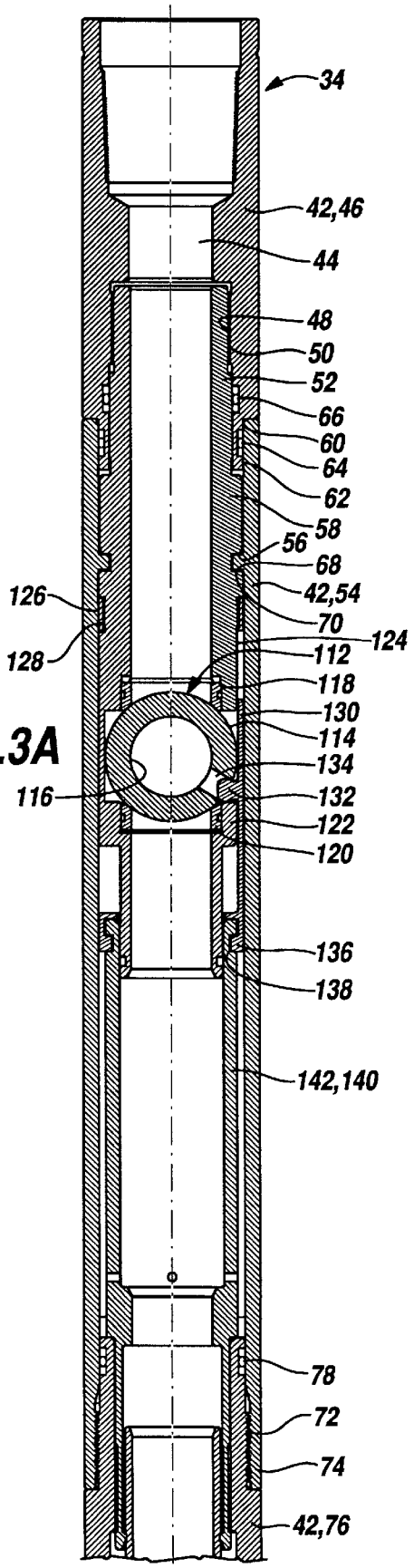
FIGS. 3A–3C, is a half-sectional view of a downhole tester valve tool of the present invention in a closed position.
Figure 2B:
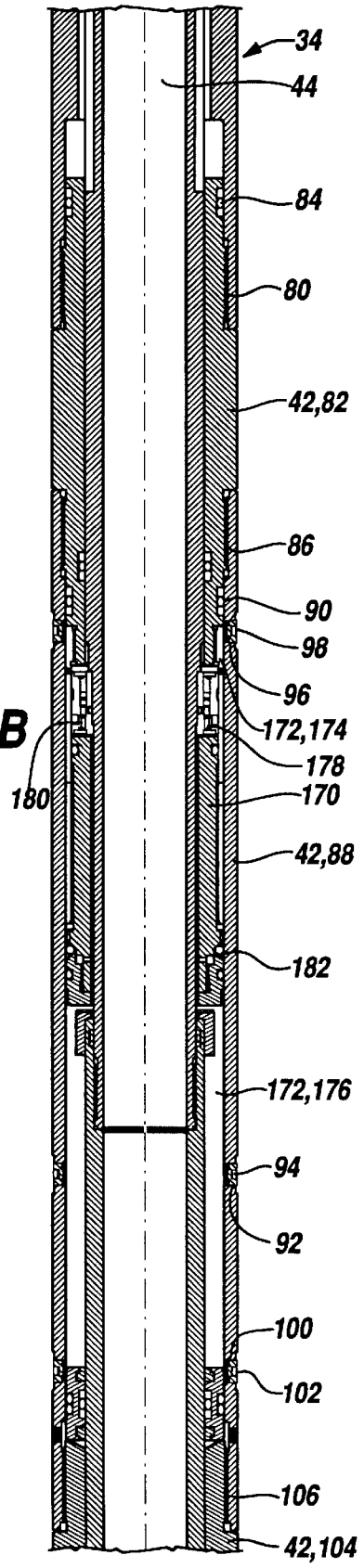
Figure 3B:
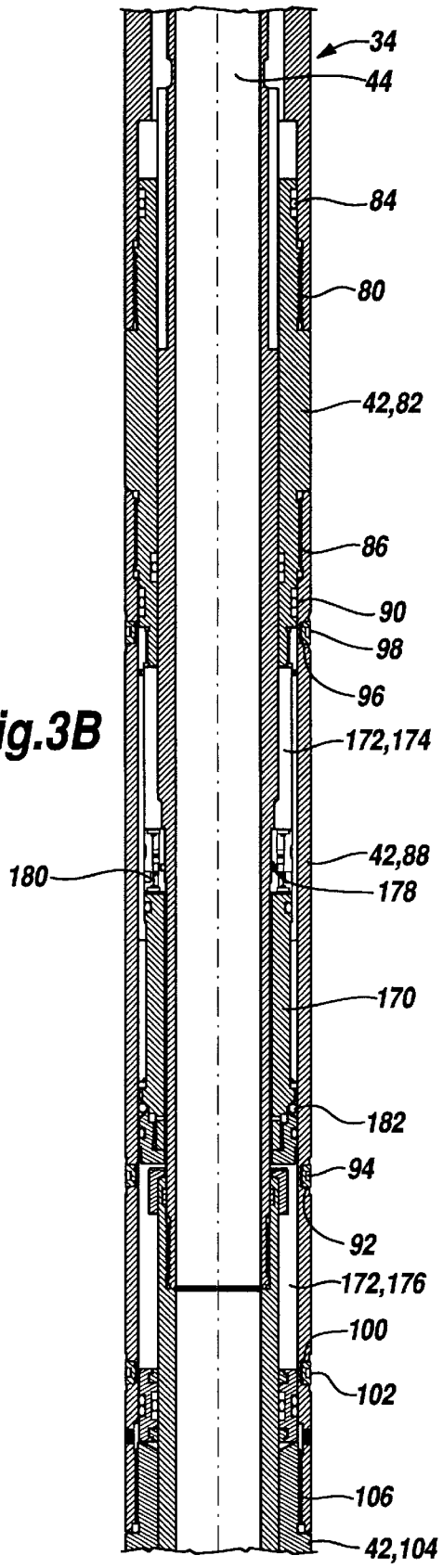

Referring to FIGS. 2 and 3, tool 34 of the present invention is depicted in an open position and a closed position, respectively. Tool 34 includes a housing 42 which is adapted to be connected with drill string 30 and which has a substantially open bore 44 therethrough. Housing 42 includes a number of generally cylindrically shaped tubular elements threadably connected together. Housing 42 includes an upper adapter 46 having a lower internal threaded surface 48, threadably engaged with an external threaded surface 50 of an upper end of upper inner housing section 52. Housing 42 further includes outercase 54, the upper portion of which is concentrically received about a lower portion of upper inner housing section 52 which extends below upper adapter 46. Outer case 54 includes a plurality of radially inwardly directed splines 56 which mesh with a plurality of radially outward directed splines 58 of upper inner housing section 52 to prevent relative rotation therebetween. An uppermost end of case 54 above splines 56 has a cylindrical inner surface 60 which is closely received about a cylindrical outer surface 62 of upper adapter 46, with seals being provided therebetween by resilient o-ring seal 64. A seal is provided between upper inner housing section 52 and upper adapter 46 by resilient o-ring seal 66.

Outer case 54 is held in place relative to upper adapter 46 and upper inner housing section 52 by upper upward facing annular shoulder 68 of upper inner housing section 52 which engages lower end 70 of splines 56. Outer case 54 has an internally threaded cylindrical surface 72 near its lower end, which is threadably connected to an externally threaded cylindrical surface 74 of an upper portion of an intermediate housing adapter 76 of housing 42. A seal is provided therebetween by resilient o-ring 78. Intermediate housing adapter 76 is threadably connected at 80 to lower intermediate housing adapter 82 of housing 42, with a seal being provided therebetween by resilient o-ring 84. Lower intermediate housing adapter 82 is threadably connected at threads 86 to the upper end of metering chamber case 88 of housing 42. A seal is provided therebetween by o-rings 90.

Metering case 88 has a fill port 92 disposed through a wall thereof which may be closed off by threaded sealed plug 94. Metering chamber case 88 also has an upper vent port 96 having a threaded sealed plug 98 therein and lower fill port 100 having a threaded sealed plug 102 therein.

Metering chamber case 88 is connected at its lower end to lower adapter 104 of housing 42 at threaded connection 106. Lower adapter 104 is connected at its lower end to rotatable sleeve case 108 of housing 42 at threaded connection 110.

Disposed within outercase 54 of housing 42 is operating assembly 112. Operating assembly 112 includes a spherical valve member 114 having a substantially open valve bore 116 therethrough. Upper and lower annular seats 118 and 120 engage the spherical valve member 114. Spherical valve member 114 is rotatable within seats 118 and 120 between a closed position as illustrated in FIG. 3A wherein spherical valve member 114 closes housing bore 44 and an open position as illustrated in FIG. 2A wherein spherical valve member 114 is rotated to a position wherein valve bore 116 is aligned with housing bore 44. Valve cage 122 surrounds spherical valve member 114 and includes at least one longitudinally extending recess 124 which is best viewed in FIG. 3A. Cage 122 includes an upper end 126 which is threadably connected to upper inner housing section 52 at threaded connection 128.

At least one actuating arm 130 having a lug 132 is received in at least one eccentric radially bore 134 of spherical valve member 114. When housing 42 is moved downward relative to actuating arm 130, actuating arm 130 rotates spherical valve member 114 to its open position. When housing 42 is moved upward relative to actuating arm 130, actuating arm 130 will rotate spherical valve member 114 to its closed position. The lower end of actuating arm 130 includes radially inward extending flange 136 which is received in groove 138 of upper adapter 140 of power mandrel assembly 142.

Power mandrel assembly 142 is generally slidably received within housing 42. Power mandrel assembly 142 is adapted to be selectively telescoped between a first and a second position relative to housing 42 to rotate spherical valve member 114 between its closed and open positions. Power mandrel assembly 142 is also adapted to be selectively rotated between a first circumferential position and a second circumferential position relative to housing 42 to lock spherical valve member 114 in an open position.

Figure 2C:
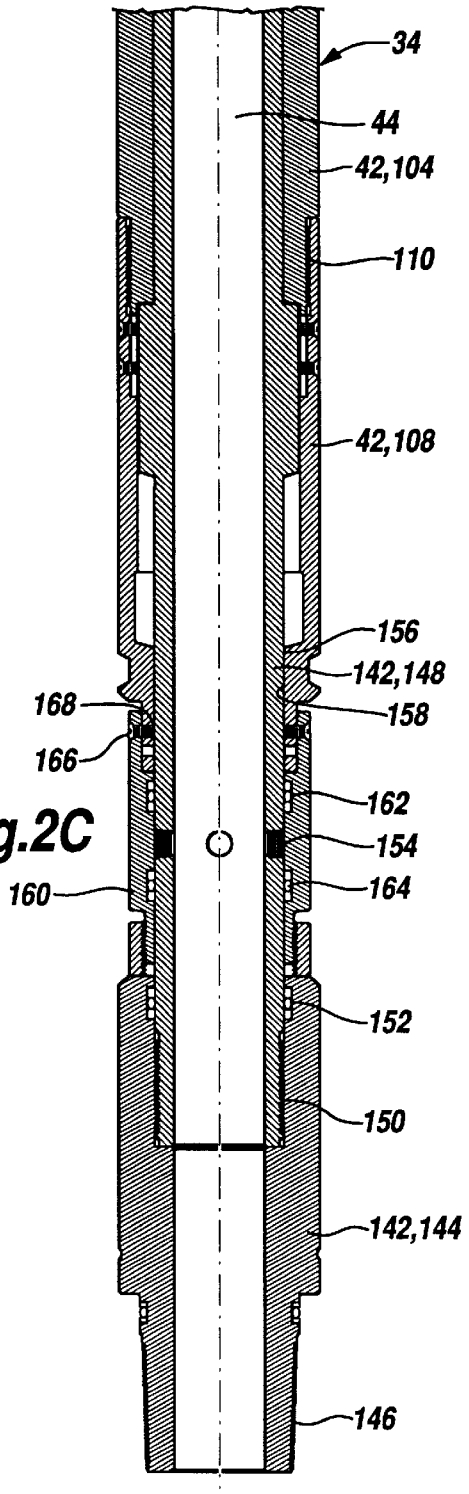
Figure 3C:
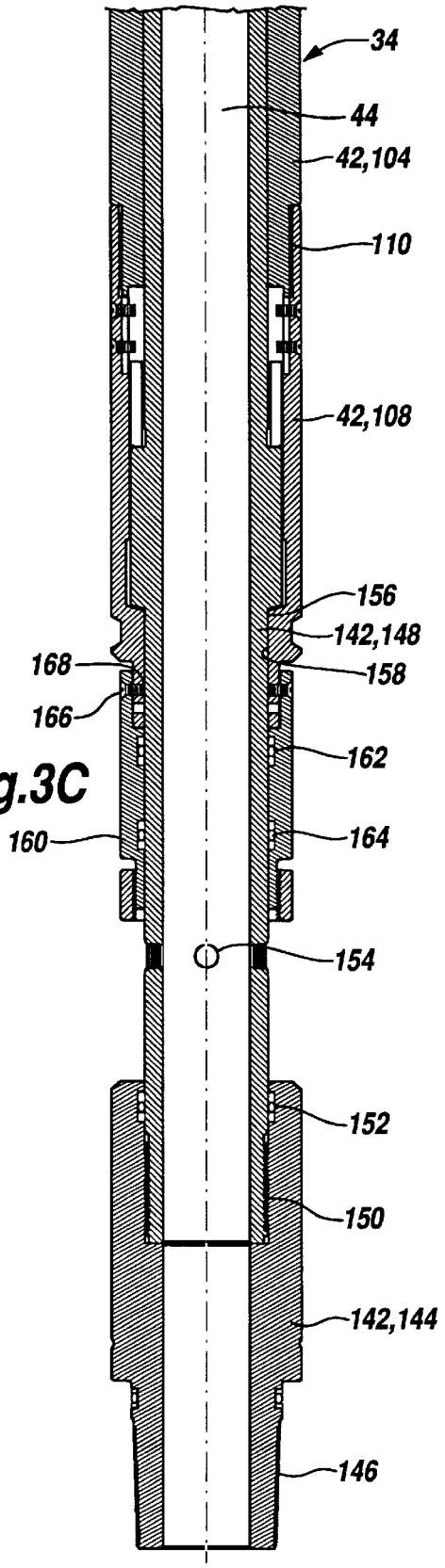

As seen in FIG. 2C and 3C, power mandrel assembly 142 includes lower adapter 144 having a lower external threaded pin end 146 for connection with pipe string 30 or an adjacent tool such as seal assembly 36 which may be located below tool 34. Bore 44, which may also be referred to as flow passage 44, extends through the various members of power mandrel assembly 142. Lower adapter 144 is connected to the lower end of lower power mandrel 148 of power mandrel assembly 142 at threaded connection 150 with a seal being provided therebetween by o-ring seal 152. A bypass port 154 is disposed through the side wall of lower power mandrel 148. Lower power mandrel 148 has a cylindrical outer surface 156 which is closely received within cylindrical inner surface 158 of rotatable sleeve case 108.

Bypass sleeve 160 is also closely received about outer surface 156 of lower power mandrel 148 and has upper and lower sliding o-rings 162 and 164, respectively, therebetween. Bypass sleeve 160 may be attached to rotatable sleeve case 108 by a set screw 166 received in groove 168 of rotatable sleeve case 108. It will be appreciated that when housing 42 moves downward relative to power mandrel assembly 142, lower seals 164 will move below bypass port 154 to close bypass port 154. As shown in FIG. 3C, bypass port 154 is in an open position when the spherical valve member 114 is in its closed position and as seen in FIG. 2C, bypass port 154 is in its closed position when spherical valve member 114 is moved to its open position.

Tool 34 is normally run into wellbore 40 with the spherical valve member 114 in its closed position as shown in FIG. 3. Seal assembly 36 is located immediately below tool 34 and fits closely with the inner surface of wellbore 40. It is desirable to have a bypass means for allowing fluid in bore 44 below the closed spherical valve member 114 to bypass seal assembly 36, thus preventing a piston type effect opposing the downward motion of test string 30 into wellbore 40. Bypass port 154, when opened, allows flow from the lower portion of bore 44 outward through bypass port 154 into wellbore 40 above string assembly 36. When the weight of drill string 30 is set down on seal assembly 36, bypass port 154 will be held open by the time delay action until after seal assembly 36 is set. This allows seal assembly 36 to be set without any differential pressure there across in wellbore 40. After seal assembly 36 is set, bypass port 154 will be closed. After bypass port 154 closes, spherical valve member 114 opens.

Alternatively, bypass sleeve 160 may be positioned as shown in FIG. 3C but without set screw 168 so that once housing 42 moves downward relative to power mandrel assembly 142, bypass sleeve 160 covers bypass port 154. Subsequently, upon moving housing 42 back upward relative to power mandrel assembly 142, the frictional engagement of upper and lower sliding o-ring seals 162 and 164 with the exterior surface 156 of lower power mandrel 148 will cause bypass sleeve 160 to be frictionally held in a closed position thereafter. In a third alternative, bypass sleeve 160 may be initially disposed about bypass ports 154 such that upper sliding o-ring seal 162 is above bypass ports 154 and lower sliding o-ring seal 164 is below bypass port 154. In this arrangement, the frictional engagement of upper and lower sliding o-ring seals 162 and 164 with the exterior surface 156 of lower power mandrel 148 causes bypass sleeve 160 to permanently be frictionally held in a closed position.

Annular metering piston 170 is disposed within oil chamber 172. Oil chamber 72 has a first portion 174 and a second portion 176 above and below metering piston 170, respectively. Metering piston 170 has a flow impedance means 178 at the upper end to provide a predetermined amount of fluid resistance to fluid flow through fluid passage 180. Metering piston 170 carries a one way o-ring seal 182 disposed thereabout for sealing between metering piston 170 and metering chamber case 88 of housing 42. When power mandrel assembly 142 slides upward relative to housing 42, fluid from first portion 174 of oil chamber 172 must flow through flow impedance means 178 to second portion 176 of oil chamber 172. The one way o-ring seal 182 provides a means to bypass between metering piston 170 and metering chamber case 88 of housing 42 when the power mandrel assembly 142 moves downward relative to housing 42.

In operation, downhole tester valve tool 34 is in its fully-extended position with spherical valve 114 closed as it would normally be when tool 34 is run into wellbore 40, as best seen in FIG. 3. After tool 34 has been run into wellbore 40 on drill string 30, seal assembly 36 may be operated to provide a seal against wellbore 40. Seal assembly 36 is typically designed to be set within wellbore 40 by setting weight down on seal assembly 36. Metering piston 170 provides a time delay for allowing this weight to be set down on seal assembly 36 to set seal assembly 36 within wellbore 40 without moving the power mandrel assembly 142 sufficiently upward within housing 42 to open spherical valve 114.

After seal assembly 36 has been set, spherical valve 114 can then be opened by setting down weight on drill string 30. This will cause housing 42 to begin to move downward relative to power manual assembly 142 which is held in a fixed position by seal assembly 36. The flow impedance means 178 will impede the flow of hydraulic fluid from first portion 174 of oil chamber 172 to second portion 176 of oil chamber 172. Typically, the flow impedance means 178 will be selected to provide approximately a two minute time delay for movement of housing 42 down sufficiently to open spherical valve 114.

Figure 4:
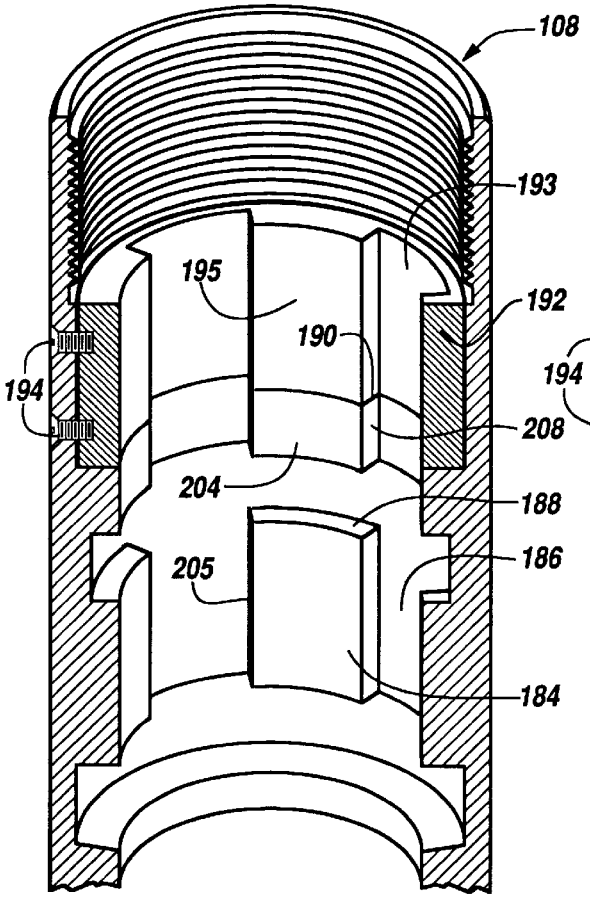
FIG. 4 is a perspective view of a rotatable sleeve case of the present invention.

Referring now to FIG. 4, a half section of rotatable sleeve case 108 is depicted in a prospective view. Rotatable sleeve case 108 includes threaded connection 110 for threadably attaching rotatable sleeve case 108 to lower adapter 104. Rotatable sleeve case 108 defines a profile along its inner circumference which includes a plurality of splines 184 and a plurality of channels 186. Each spline 184 of rotatable sleeve case 108 includes upper shoulders 188 and 190. A sleeve assembly 192 is closely received within rotatable sleeve case 108. Sleeve assembly 192 is rotatable within rotatable sleeve case 108. Sleeve assembly 192 is designed to receive set screws 194 which extend through rotatable sleeve case 108 to prevent relative rotational movement between sleeve assembly 192 and rotatable sleeve case 108. Sleeve assembly 192 defines a profile along its inner circumference which includes a plurality of channels 193 and a plurality of splines 195.

Figure 5:
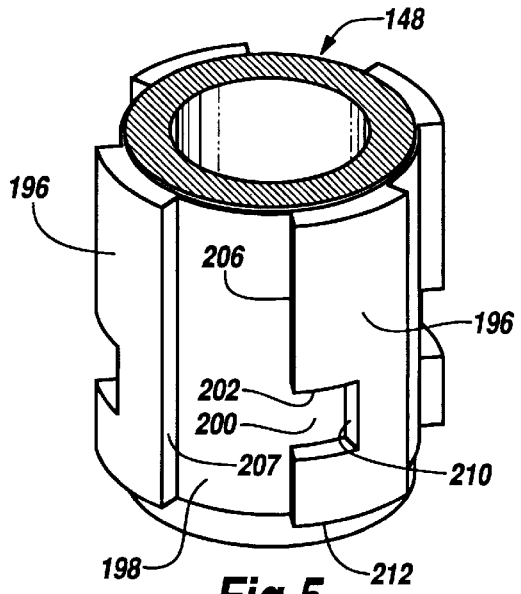
FIG. 5 is a perspective view of a section of a power mandrel of the present invention.

Referring to FIG. 5, a section of lower power mandrel 148 is depicted in a perspective view. Lower power mandrel 148 defines a profile around its outer circumference which includes a plurality of splines 196 and channels 198. Each spline 196 includes a notch 200 and a lower shoulder 202.

As previously stated, in operation tool 34 is in its fully extended position with spherical valve 114 closed as tool 34 is run into wellbore 40. After seal assembly 36 is set against wellbore 40, spherical valve 114 may be opened by setting weight down on drill string 30, causing housing 42 to move downward relative to power member assembly 142. As rotatable sleeve case 108 of housing 42 moves downward relative to lower power mandrel 148 of power mandrel assembly 142, splines 196 of lower power mandrel 148 are closely received within and slide relative to channels 186 of rotatable sleeve case 108 and channels 193 of sleeve assembly 192. Similarly, splines 184 of rotatable sleeve case 108 and splines 195 of sleeve assembly 192 are closely received within and slide relative to channels 198 of lower power mandrel 148. Once housing 42 completes is full downward motion relative to power mandrel assembly 142 and spherical valve member 114 has operated to its fully-open position, notch 200 of spline 196 of lower power mandrel 148 is aligned with upper section 204 of spline 184 of rotatable sleeve case 108. Also, lateral shoulder 206 of spline 196 of lower power mandrel 148 is aligned with spline 195 of sleeve assembly 192.

Tool 34 is now in the fully-contracted position as shown in FIG. 2. Tool 34 may be returned to its fully-extended position simply by lifting drill string 30 off of tool 34. Alternatively, drill string 30 may be rotated in a first direction creating a torsional force on sleeve assembly 192 as sleeve assembly 192 contacts lateral shoulder 206 of spline 196. When the torsional force reaches a predetermined level, set screws 194 will shear allowing sleeve assembly 192 to rotate relative to rotatable sleeve case 108, thereby allowing rotatable sleeve case 108 to rotate relative to lower power mandrel 148. Rotatable sleeve case 108 rotates relative to lower power mandrel 148 until lateral shoulder 208 of upper section 204 of spline 184 contacts lateral shoulder 210 of notch 200 of channel 196. In this position, if the weight of drill string 30 is lifted off of tool 34, upper shoulder 190 of upper section 204 of spline 184 contacts lower shoulder 202 of spline 196 and upper shoulder 188 of spline 184 contacts lower shoulder 212 of spline 196 which prevents relative longitudinal movement between rotatable sleeve case 108 and lower power mandrel 148 which, in turn, prevents relative longitudinal movement between housing 42 and power mandrel assembly 142, thereby locking spherical valve member 114 in an open position. Tool 34 can be returned to normal operation by rotating drill string 30 in a second direction so that rotatable sleeve case 108 rotates relative to lower power mandrel 148 until lateral shoulder 205 of spline 184 contacts lateral shoulder 207 of spline 196.

Figure 6:
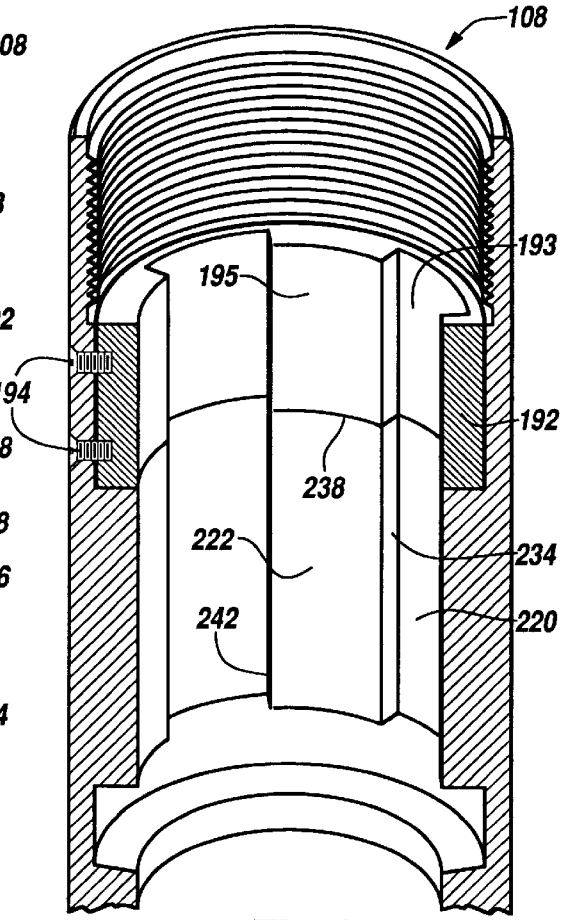
FIG. 6 is a perspective view of a rotatable sleeve case of the present invention.

Referring to FIG. 6, an alternate embodiment of rotatable sleeve case 108 is depicted. Rotatable sleeve case 108 defines a profile along its inner circumference which includes a plurality of channels 220 and a plurality of splines 222. Sleeve assembly 192 is closely received by rotatable sleeve case 108 and is rotatable within rotatable sleeve case 108. Sleeve assembly 192 defines a profile along its inner circumference which includes a plurality of channels 193 and a plurality of splines 195. A plurality of set screws 194 are received within sleeve assembly 192 through rotatable sleeve case 108 to prevent relative rotational movement between sleeve assembly 192 and rotatable sleeve case 108.

Figure 7:
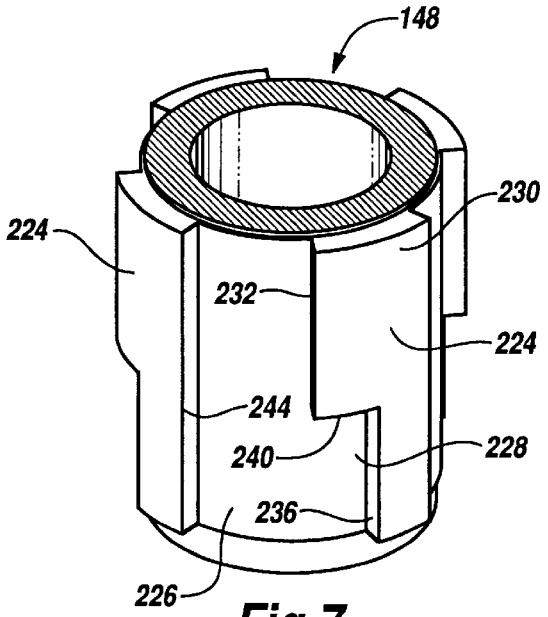
FIG. 7 is a perspective view of a section of a power mandrel of the present invention.

In FIG. 7, a section of lower power mandrel 148 is represented in a perspective view. Lower power mandrel 148 has an outer profile which includes a plurality of splines 224 and a plurality of channels 226. Spline 224 defines notch 228. Referring to FIGS. 6 and 7 together, splines 224 of lower power mandrel 148 are closely received in channels 220 of rotatable sleeve case 108 and channels 193 of sleeve assembly 192. Similarly, splines 222 of rotatable sleeve case 108 and splines 195 of sleeve assembly 192 are closely received and slidable within channels 226 of lower power mandrel 148.

In operation, when the weight of drill string 30 is set down on tool 34 and tool 34 is in its fully-compressed position with spherical valve member 114 in an open position, upper portion 230 of spline 224 of lower power mandrel 148 is aligned with spline 195 of sleeve assembly 192. If drill string 30 is rotated in a first direction, a torsional force is created on sleeve assembly 192 by lateral shoulder 232 of spline 224. When the torsional force reaches a predetermined level, set screws 194 shear, allowing sleeve assembly 192 to rotate relative to rotatable sleeve case 108, thereby allowing rotatable sleeve case 108 to rotate relative to lower power mandrel 148. Rotatable sleeve case 108 will rotate relative to lower power mandrel 148 until lateral shoulder 234 of spline 222 of rotatable sleeve case 108 contacts lateral shoulder 236 of spline 224 of lower power mandrel 148. In this position, if the weight of pipe string 30 is lifted off of tool 34, upper shoulder 238 of spline 222 contacts lower shoulder 240 of spline 224 which prevents relative longitudinal movement between rotatable sleeve case 108 and lower power mandrel 148 which, in turn, prevents relative longitudinal movement between housing 42 and power mandrel assembly 142, thereby locking spherical valve member 114 in an open position. Tool 34 can be returned to normal operation by rotating drill string 30 in a second direction so that rotatable sleeve case 108 rotates relative to lower power mandrel 148 until lateral shoulder 242 of spline 222 contacts lateral shoulder 244 of spline 224.

Therefore, the apparatus and method for selectively locking a downhole tester valve in an open position has inherent advantages over the prior art. As certain embodiments of the invention have been illustrated for the purposes of this disclosure, numerous changes in the arrangement and construction of the parts may be made by those skilled in the art, which changes are embodied within the scope and spirit of the present invention as defined by the appended claims.

What is claimed is:

1. A downhole tool apparatus comprising:

a housing;

an operating assembly disposed in said housing; and a mandrel axially movable in said housing to engage and operate said operating assembly, said mandrel rotatably movable in said housing to selectively lock said mandrel axially relative to said housing.

2. The downhole tool as recited in claim 1 further comprising a sleeve assembly rotatably disposed within said housing for receiving said mandrel.

3. The downhole tool as recited in claim 2 wherein said housing defines a channel and wherein said sleeve assembly defines a channel.

4. The downhole tool as recited in claim 3 wherein said mandrel further includes a spline that is longitudinally movable within said channel of said housing and said channel of said sleeve.

5. The downhole tool as recited in claim 4 wherein said housing has an upper shoulder and wherein said spline of said mandrel has a lower shoulder such that when said mandrel is rotated relative to said housing, said upper shoulder of said housing is in close contact with said lower shoulder of said mandrel, thereby locking said mandrel axially relative to said housing.

6. The downhole tool as recited in claim 4 wherein said housing has first and second upper shoulders and wherein said spline of said mandrel has first and second lower shoulders such that when said mandrel is rotated relative to said housing, said first upper shoulder of said housing is in close contact with said first lower shoulder of said mandrel and said second upper shoulder of said housing is in close contact with said second lower shoulder of said mandrel, thereby locking said mandrel axially relative to said housing.

7. The downhole tool as recited in claim 2 wherein said housing defines a plurality of sheer member openings and wherein said sleeve assembly defines a plurality of sheer member openings.

8. The downhole tool as recited in claim 7 further comprising a plurality of sheer members inwardly radially extending through said sheer member openings of said housing to said sheer member openings of said sleeve assembly to prevent relative rotation between said housing and said sleeve assembly until a predetermined amount of torsional force is applied to said sleeve assembly.

9. A downhole tool apparatus comprising:

a housing;

an operating assembly disposed in said housing having open and closed positions;

a mandrel slidably received in said housing and adapted to be selectively telescoped between first and second axial positions relative to said housing to manipulate said operating assembly between said open and closed positions, said mandrel adapted to be selectively rotated between first and second circumferential positions relative to said housing to selectively lock said mandrel axially relative to said housing.

10. The downhole tool as recited in claim 9 wherein said mandrel is axially slidable relative to said housing when said mandrel is in said first circumferential position relative to said housing and wherein said mandrel is axially fixed relative to said housing when said mandrel is in said second circumferential position relative to said housing.

11. The downhole tool as recited in claim 10 wherein said operating assembly is in said open position when said mandrel is in said second circumferential position relative to said housing.

12. The downhole tool as recited in claim 10 wherein said operating assembly is in said closed position when said mandrel is in said second circumferential position relative to said housing.

13. The downhole tool as recited in claim 9 wherein said housing defines a channel and a first upper shoulder and wherein said mandrel further includes a spline having a first lower shoulder, said spline axially movable within said channel of said housing, said first upper shoulder of said housing is in close contact with said first lower shoulder of said mandrel when said mandrel is rotated to said second circumferential positions relative to said housing, thereby locking said mandrel axially relative to said housing.

14. The downhole tool as recited in claim 13 wherein said housing further includes a second upper shoulder and wherein said spline of said mandrel further includes a second lower shoulder, said second upper shoulder of said housing is in close contact with said second lower shoulder of said mandrel when said mandrel is rotated to said second circumferential positions relative to said housing, thereby locking said mandrel axially relative to said housing.

15. The downhole tool as recited in claim 9 further comprising a sleeve assembly rotatably disposed within said housing for receiving said mandrel.

16. The downhole tool as recited in claim 15 wherein said housing defines a plurality of sheer member openings and wherein said sleeve assembly defines a plurality of sheer member openings.

17. The downhole tool as recited in claim 16 further comprising a plurality of sheer members inwardly radially extending through said sheer member openings of said housing to said sheer member openings of said sleeve assembly to prevent relative rotation between said housing and said sleeve assembly until a predetermined amount of torsional force is applied to said sleeve assembly.

18. A method for selectively locking a downhole tool in an open position comprising:

running said tool into a wellbore;

setting the weight of a pipe string down on said tool;

moving a housing of said tool from a first axial positions to a second axial position relative to a mandrel, said mandrel slidably disposed within said housing;

operating an operating assembly disposed within said housing from a closed position to an open position;

rotating said housing in a first direction relative to said mandrel; and locking said mandrel axially relative to said housing, thereby locking said operating assembly in said open position.

19. The method as recited in claim 18 further comprising the steps of:

lifting the weight of said pipe string off said tool; and maintaining said housing in said second axial positions relative to said mandrel, thereby maintaining said operating assembly in said open position.

20. The method as recited in claim 18 further comprising the steps of:

rotating said housing in a second direction relative to said mandrel;

lifting the weight of said pipe string off said tool;

sliding said housing from said second axial positions to said first axial position relative to said mandrel; and operating said operating assembly from said open position to said closed position.

21. A method for selectively locking a downhole tool in a closed position comprising:

running said tool into a wellbore;

setting the weight of a pipe string down on said tool;

moving a housing of said tool from a first axial positions to a second axial position relative to a mandrel, said mandrel slidably disposed within said housing;

operating an operating assembly disposed within said housing from an open position to a closed position;

rotating said housing in a first direction relative to said mandrel; and locking said mandrel axially relative to said housing, thereby locking said operating assembly in said closed position.

22. The method as recited in claim 21 further comprising the steps of:

lifting the weight of said pipe string off said tool; and maintaining said housing in said second axial positions relative to said mandrel, thereby maintaining said operating assembly in said closed position.

23. The method as recited in claim 21 further comprising the steps of:

rotating said housing in a second direction relative to said mandrel;

lifting the weight of said pipe string off said tool;

sliding said housing from said second axial positions to said first axial position relative to said mandrel; and operating said operating assembly from said closed position to said open position.

* * * * *